US010466018B2

(12) United States Patent
Boos et al.

(10) Patent No.: US 10,466,018 B2
(45) Date of Patent: Nov. 5, 2019

(54) SHELL FOR HOUSING AN EXPLOSIVE MATERIAL FOR USE IN MINING

(71) Applicant: ORICA INTERNATIONAL PTE LTD, Singapore (SG)

(72) Inventors: Thomas Boos, Niederkassel (DE); Yu Wen, Malvern (AU)

(73) Assignee: Orica International PTE LTD, Singapore (SG)

( * ) Notice: Subject to any disclaimer, the term of this patent is extended or adjusted under 35 U.S.C. 154(b) by 3 days.

(21) Appl. No.: 15/322,800

(22) PCT Filed: Jul. 1, 2015

(86) PCT No.: PCT/IB2015/054946
§ 371 (c)(1),
(2) Date: Dec. 29, 2016

(87) PCT Pub. No.: WO2016/001850
PCT Pub. Date: Jan. 7, 2016

(65) Prior Publication Data

US 2018/0202780 A1 Jul. 19, 2018

(30) Foreign Application Priority Data

Jul. 2, 2014 (AU) ..... 2014902540

(51) Int. Cl.
*F42B 3/00* (2006.01)
*F42B 3/26* (2006.01)
(Continued)

(52) U.S. Cl.
CPC ..... *F42B 3/26* (2013.01); *F42D 1/043* (2013.01); *F42D 3/04* (2013.01)

(58) Field of Classification Search
CPC ..... F42B 3/26; F42B 3/00; F42D 1/04; F42D 1/043; F42D 3/04; C06C 7/00
(Continued)

(56) References Cited

U.S. PATENT DOCUMENTS 3,058,419 A * 10/1962 O'Brien ..... F42B 3/26 102/331
3,141,410 A * 7/1964 Gundlach ..... C06C 7/00 102/318
(Continued)

FOREIGN PATENT DOCUMENTS

AU 616 320 5/1990
AU 708 917 5/1996
(Continued)

OTHER PUBLICATIONS

European Patent Office, "Supplementary EP Search Report of EP Application No. EP 15 81 5245," dated Jan. 25, 2018.
(Continued)

*Primary Examiner* — Michael D David
(74) *Attorney, Agent, or Firm* — Daniel A. Thomson; Emerson THomson Bennett, LLC

(57) ABSTRACT

A shell for use in blasting, the shell comprising an elongated body, the elongated body having a distal end arranged for housing an explosive material, a proximal end arranged to permit introduction of at least one detonator into an interior of the shell, and a cavity for holding the at least one detonator in a location in which operation of the detonator results in explosion of the explosive material, wherein a slot is provided in a sidewall of the shell to allow an activation lead connected to the detonator to pass through the slot to an exterior of the shell, and wherein the slot includes at least one retaining protrusion to retain the activation lead against withdrawal of the activation lead from the slot.

11 Claims, 13 Drawing Sheets

(51) Int. Cl.
*F42D 3/04* (2006.01)
*F42D 1/04* (2006.01)

(58) Field of Classification Search
USPC ..... 102/331, 275.12, 318, 322, 275.4
See application file for complete search history.

(56) References Cited

U.S. PATENT DOCUMENTS 3,183,836 A * 5/1965 Griffith ..... F42B 3/00 102/331
3,604,353 A * 9/1971 Newman ..... F42B 1/04 102/332
3,955,504 A * 5/1976 Romney ..... F42B 3/00 102/306
4,023,494 A * 5/1977 Barton ..... F42B 3/00 102/314
4,060,034 A * 11/1977 Bowman ..... F42D 1/06 102/275.5
4,165,691 A * 8/1979 Bowman ..... F42D 1/06 102/275.7
4,178,852 A * 12/1979 Smith ..... F42B 3/26 102/275.4
4,226,184 A 10/1980 Carter
4,295,424 A * 10/1981 Smith ..... F42B 3/26 102/275.4
4,383,484 A 5/1983 Morrey
4,425,849 A * 1/1984 Jorgenson ..... F42D 1/045 102/200
4,487,129 A * 12/1984 Isaac ..... F42B 3/00 102/313
4,527,482 A * 7/1985 Hynes ..... F42D 1/04 102/275.2
4,637,312 A * 1/1987 Adams ..... F42B 3/26 102/275.12
4,718,345 A * 1/1988 Yunan ..... F42D 1/04 102/275.12
4,776,276 A * 10/1988 Yunan ..... C06B 45/00 102/275.12
4,796,533 A * 1/1989 Yunan ..... F42B 3/26 102/275.12
4,799,428 A * 1/1989 Yunan ..... C06C 7/00 102/275.12
5,435,250 A * 7/1995 Pollock ..... F42B 3/00 102/317
5,614,693 A * 3/1997 Welch ..... C06C 5/06 102/275.4
5,661,256 A * 8/1997 Sutula, Jr. ..... C06C 5/06 102/275.12
5,763,816 A * 6/1998 Keeling ..... C06C 7/00 102/275.11
5,780,764 A * 7/1998 Welch ..... F42D 1/043 102/275.4
5,872,326 A 2/1999 Manhart
6,186,069 B1 * 2/2001 Dippenaar ..... F42D 1/04 102/275.4
6,295,912 B1 * 10/2001 Burleson ..... C06C 5/06 102/275.12
6,644,203 B1 11/2003 Powell
7,743,709 B2 * 6/2010 Kolnik ..... F42B 14/064 102/521
7,778,006 B2 * 8/2010 Stewart ..... F42D 1/05 361/248
7,823,508 B2 * 11/2010 Anderson ..... F42B 3/26 102/202.12
8,127,682 B1 * 3/2012 Sonday ..... C06C 7/00 102/275.4
9,115,963 B2 * 8/2015 Most ..... F42B 3/26
9,285,199 B2 * 3/2016 Beikoff ..... F42B 3/26
D773,597 S * 12/2016 Crossman ..... D22/112
9,520,249 B2 * 12/2016 Bonavides ..... H01H 5/04
2007/0207669 A1 * 9/2007 Hummel ..... F42B 3/103 439/606
2008/0210118 A1 9/2008 Chan et al.

FOREIGN PATENT DOCUMENTS

AU 2012 205 130 1/2013
WO 2010 016 775 2/2010

OTHER PUBLICATIONS

Australian Patent Office, "International Search Report of PCT Application PCT/IB2015/054946," dated Sep. 15, 2015.
WIPO, Search Report, WO 2016 001 850, dated Jan. 7, 2016.

* cited by examiner

SHELL FOR HOUSING AN EXPLOSIVE MATERIAL FOR USE IN MINING

FIELD OF THE INVENTION

The invention relates to a shell for use in blasting.

BACKGROUND OF THE INVENTION

Blasting is a common technique in mining for fracturing a substrate, such as rock, to facilitate excavation and removal. Blasting involves controlled explosions, typically using shells that contain an explosive charge that is initiated by a detonator. A detonator is a device for initiating an explosive, and may be in the form of an explosive device that has transmission wires/leads attached to initiate the explosive from a remote position on the surface. The explosive charge is primed with the detonator sitting in the explosive or explosive cavity region, with the transmission wires/leads protruding outside the shell and any attached anchoring devices up to the surface of the blasthole.

There exists a problem in that the reliability of operation of the shell may be detrimentally impacted where a detonator is not positioned up against an end of a cavity within a booster shell. This positioning increases the chance of a misfire and potentially reduces booster output. Accordingly, it would be advantageous to provide a shell design which allows detonators having different lengths to be securely enclosed and positioned in a correct location inside the booster shell.

In embodiments, the present invention seeks to provide a shell which overcomes or at least alleviates one or more disadvantages associated with existing shells.

SUMMARY OF THE INVENTION

In accordance with one aspect of the present invention, there is provided a shell for use in blasting, the shell comprising an elongated body, the elongated body having a distal end arranged for housing an explosive material, a proximal end arranged to permit introduction of at least one detonator into an interior of the shell, and a cavity for holding the at least one detonator in a location in which operation of the detonator results in explosion of the explosive material, wherein a slot is provided in a sidewall of the shell to allow an activation lead connected to the detonator to pass through the slot to an exterior of the shell, and wherein the slot includes at least one retaining protrusion to retain the activation lead against withdrawal of the activation lead from the slot.

The shell may include a plurality of retaining protrusions along the slot to provide a plurality of positions along the slot at which the activation lead can be retained. The retaining protrusions may be at regular spaced intervals along the slot. In one form, the retaining protrusions are along only one side of the slot and an opposite side of the slot includes a smooth wall adapted to bear against the activation lead while the activation lead is drawn inwardly along the slot past one or more of the retaining protrusions.

The retaining protrusions may be in the form of a series of angled/barbed teeth to facilitate movement of the activation lead into the slot and to restrain the activation lead against movement out of the slot.

In one form, the slot includes a proximal barb on an opposite side of the slot to the at least one retaining protrusion and wherein the proximal barb laterally overlaps the retaining protrusion across the width of the slot.

The elongated body may be arranged for insertion and explosion in a hole.

The retaining protrusion may be adapted to hold the detonator in a location in which operation of the detonator results in explosion of the explosive material.

The retaining protrusions may be adapted to hold a range of detonators of different lengths in a location in which a distal end of the detonator is positioned against an end of the cavity such that operation of the detonator results in explosion of the explosive material. The retaining protrusions may be adapted to accommodate any length of detonator, such as, for example detonators ranging from a length of about 64 mm to about 99 mm.

In one form, the slot extends longitudinally along the sidewall from an opening of the slot at the proximal end of the sidewall.

The lead may be in the form of an activation wire. Alternatively, the lead may be in the form of a shock-tube for a non-electric detonator.

BRIEF DESCRIPTION OF THE DRAWINGS

The invention is described, by way of non-limiting example only, with reference to the accompanying drawings, in which.

DETAILED DESCRIPTION

With reference to FIGS. 1 to 10, there is shown a shell 10 for use in blasting, the shell 10 comprising an elongated body 12 arranged for insertion and explosion in a hole, for example, for use in tunnelling and underground development blasting seismic exploration operations. Advantageously, the shell 10 has a slot and a series of retaining projections so as to ensure detonators of different lengths are securely positioned directly inside the shell 10 so as to maintain reliable operation of the shell 10, reducing the chance of a misfire and increasing booster output.

Figure 1:
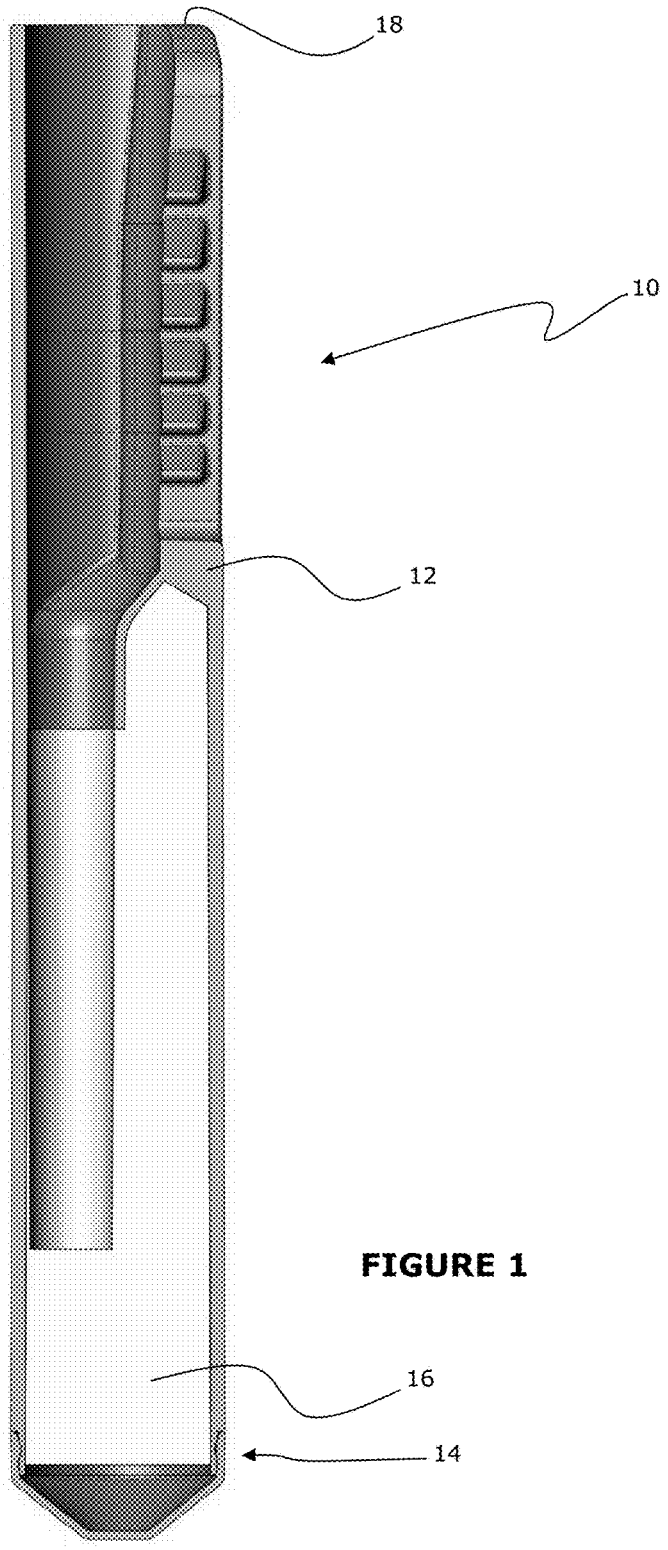
FIG. 1 is a sectional view of a shell for use in blasting in accordance with an example of the present invention.

More specifically, with reference to FIGS. 1 to 10, there is shown a shell 10 for use in blasting, the shell 10 comprising an elongated body 12, the elongated body 12 having a distal end 14 arranged for housing an explosive material 16, as shown in FIG. 1. The elongated body 12 also has a proximal end 18 arranged to permit introduction of at least one detonator 20 into an interior of the shell 10. The shell 10 also includes a cavity 22 for holding the at least one detonator in a location in which operation of the detonator 20 results in explosion of the explosive material 16. Specifically, the shell 10 includes a slot 24 provided in a sidewall 26 of the shell 10 to allow an activation lead 28 connected to the detonator 20 to pass through the slot 24 to an exterior of the shell 10. The slot 24 includes at least one retaining protrusion 30 to retain the activation lead 28 against withdrawal of the activation lead 28 from the slot 24.

Figure 2:
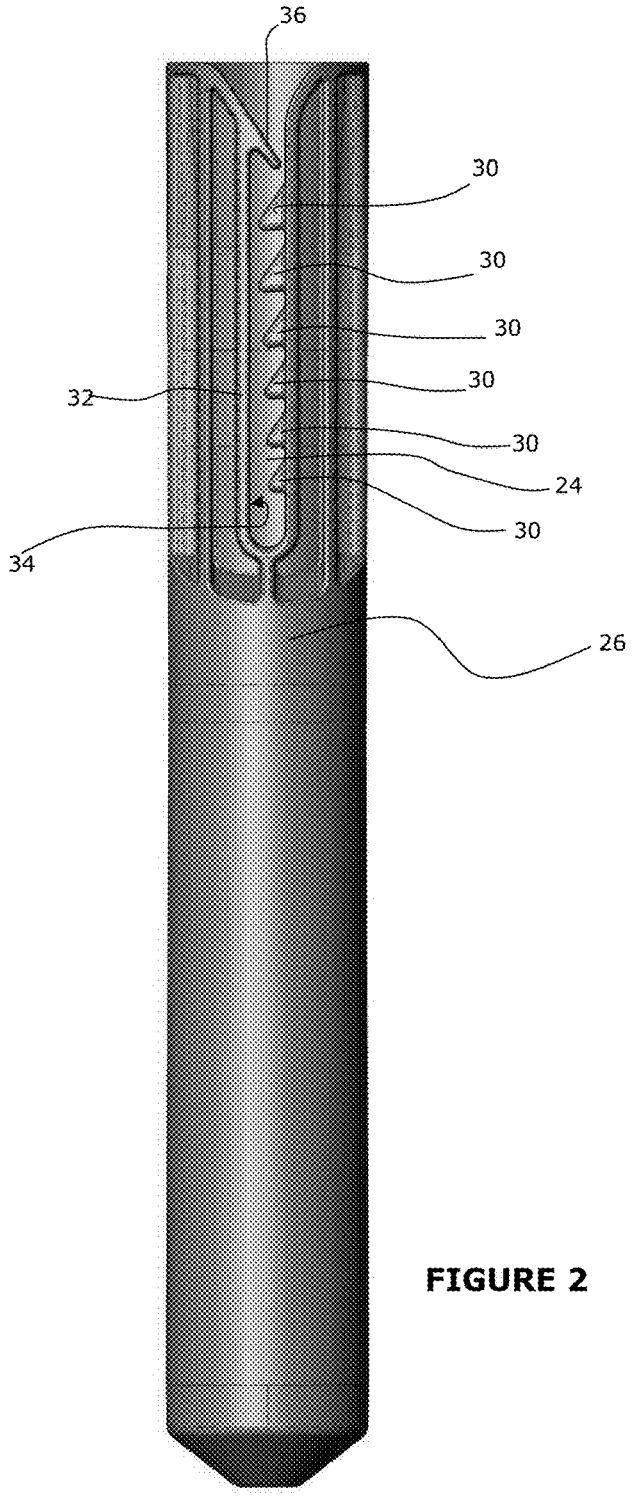
FIG. 2 is a front view of the shell.

As depicted in FIG. 1 and FIG. 2, the shell 10 includes a plurality of retaining protrusions 30 along the slot 24 to provide a plurality of positions along the slot 24 at which the activation lead 28 can be retained. The retaining protrusions 30 are at regular spaced intervals along the slot 24. As can be seen in FIG. 2, the retaining protrusions 30 are along only one side of the slot and an opposite side 32 of the slot includes a smooth wall 34 adapted to bear against the activation lead 28 while the activation lead 28 is drawn inwardly along the slot 24 past one or more of the retaining protrusions 30.

The retaining protrusions 30 are in the form of a series of angled/barbed teeth to facilitate movement of the activation lead 28 into the slot 24 and to restrain the activation lead 28 against movement out of the slot 24. More particularly, the retaining protrusions 30 serve to restrain the activation lead 28 against movement out of the slot 24, in a direction longitudinally of the slot 24. As depicted clearly in FIG. 2, the slot 24 includes a proximal barb 36 on the opposite side 32 of the slot 24 to the at least one retaining protrusion 30. The proximal barb 36 laterally overlaps the retaining protrusions 30 across the width of the slot 24. As can be seen in FIG. 2, the retaining protrusions 30 extend across a majority of the width of the slot, and the proximal barb 36 also extends across a majority of the width of the slot 24. The retaining protrusions 30 and the proximal barb 36 may be dimensioned such that the activation lead 28 causes elastic deformation of the shell 10 and/or the activation lead 28 itself as the activation lead 28 is moved along the slot 24 past the proximal barb 36 and the retaining protrusions 30.

In examples of the invention, teeth/barbs may be positioned on alternating sides of the slot 24. The benefit of having teeth/barbs on alternate sides is to secure the lead better. The drawback will be that it may slow down the insertion process and the likelihood of lead/tube damage can be higher. The proximal barb 36 should be on the opposite side of the slot 24 for a design in which all teeth are on the one side, or on the alternating side from the first tooth in the case of alternating teeth.

The elongated body 12 is generally circular in cross-section and is generally cylindrical in shape to facilitate insertion and explosion in a hole. The distal end 14 may have a tapered, rounded or pointed end to facilitate insertion in a blast hole.

With reference to FIGS. 3 to 10, the retaining protrusions 30 are adapted to hold the detonator 20 in a location in which operation of the detonator 20 results in explosion of the explosive material 16. More specifically, the retaining protrusions 30 are adapted to hold a range of detonators 20 of different lengths in a location in which a distal end of the detonator 20 is positioned against an end of the cavity 22 such that operation of the detonator 20 results in explosion of the explosive material 16. The retaining protrusions 30 may be adapted to accommodate detonators ranging from a length of 64 mm (2.5 inches) to 99 mm (3.9 inches).

Figure 3:
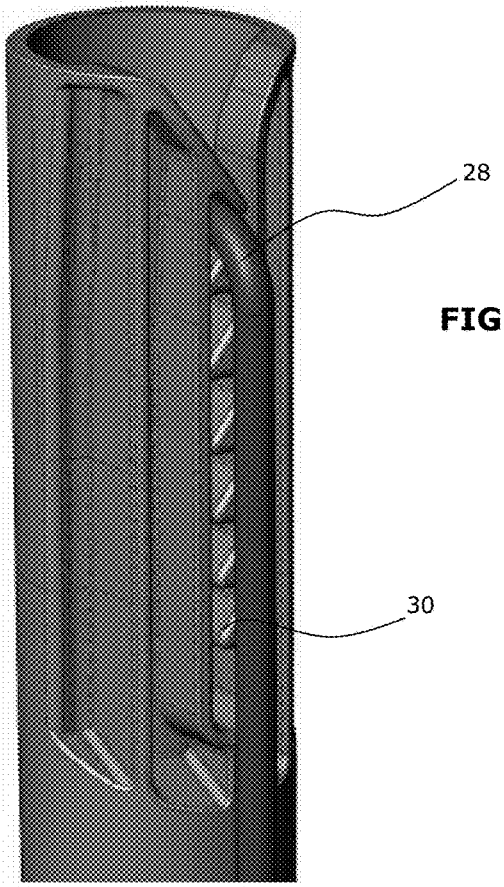
FIG. 3 is a detailed front perspective view of the shell, showing an activation lead when a longest detonator is used.
Figure 4:
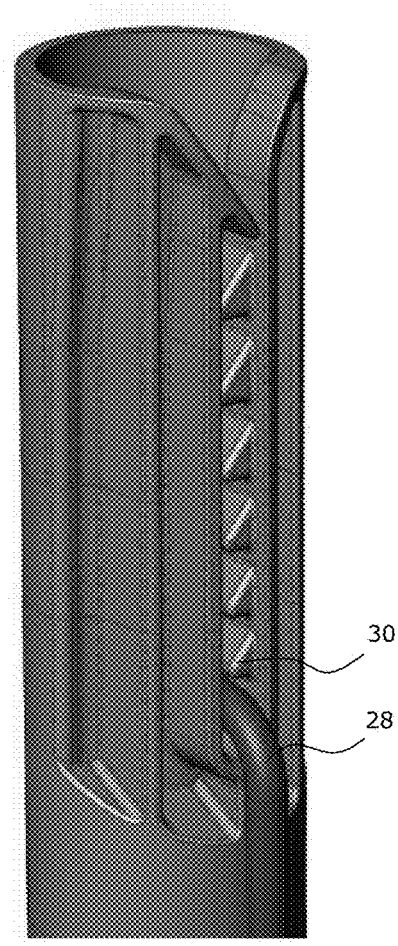
FIG. 4 is a detailed front perspective view of the shell showing an activation lead when a shortest detonator is used.

More specifically, FIG. 3 shows detail of an activation lead 28 being restrained by the proximal barb 36 when a longest detonator is inserted in place within the cavity 22. In contrast, FIG. 4 shows the activation lead 28 retained by the inner-most of the retaining protrusions 30 when the shortest detonator 20 is located in place in the cavity 22.

Figure 5:
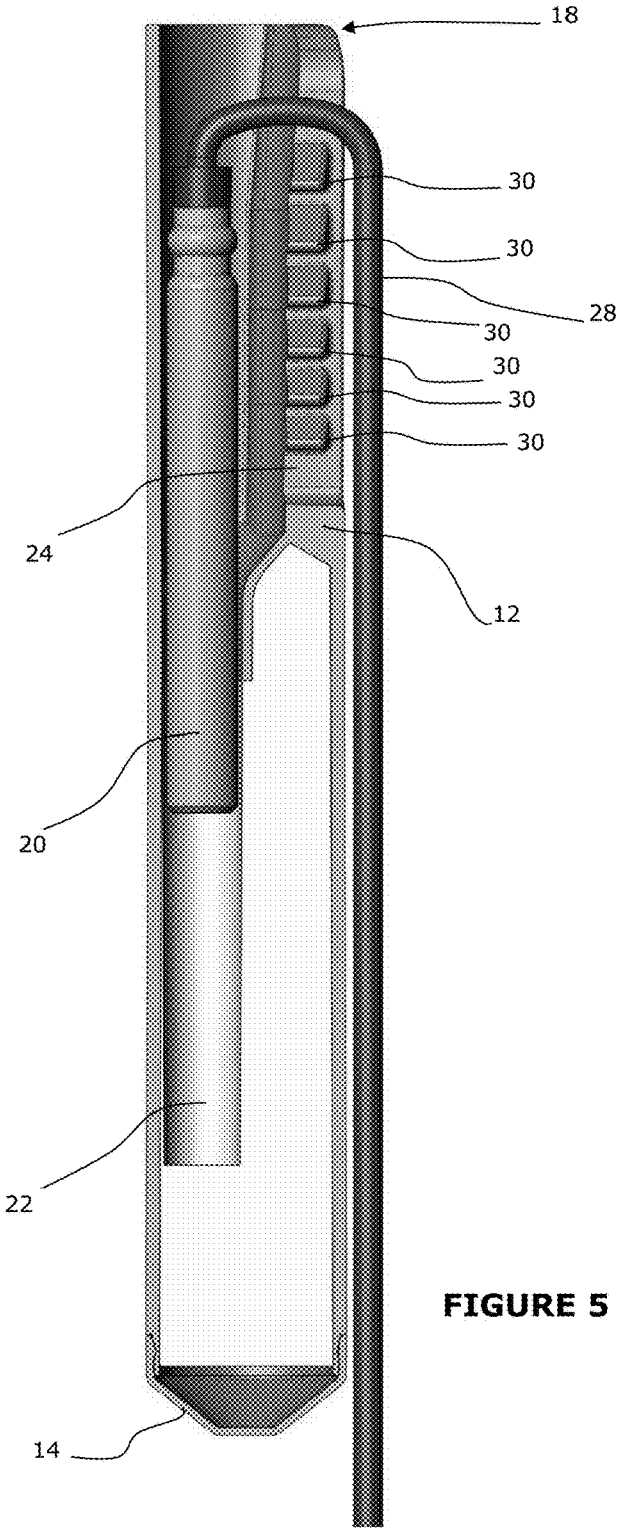
FIG. 5 is a sectional view of the shell, shown during insertion of a shortest detonator.
Figure 6:
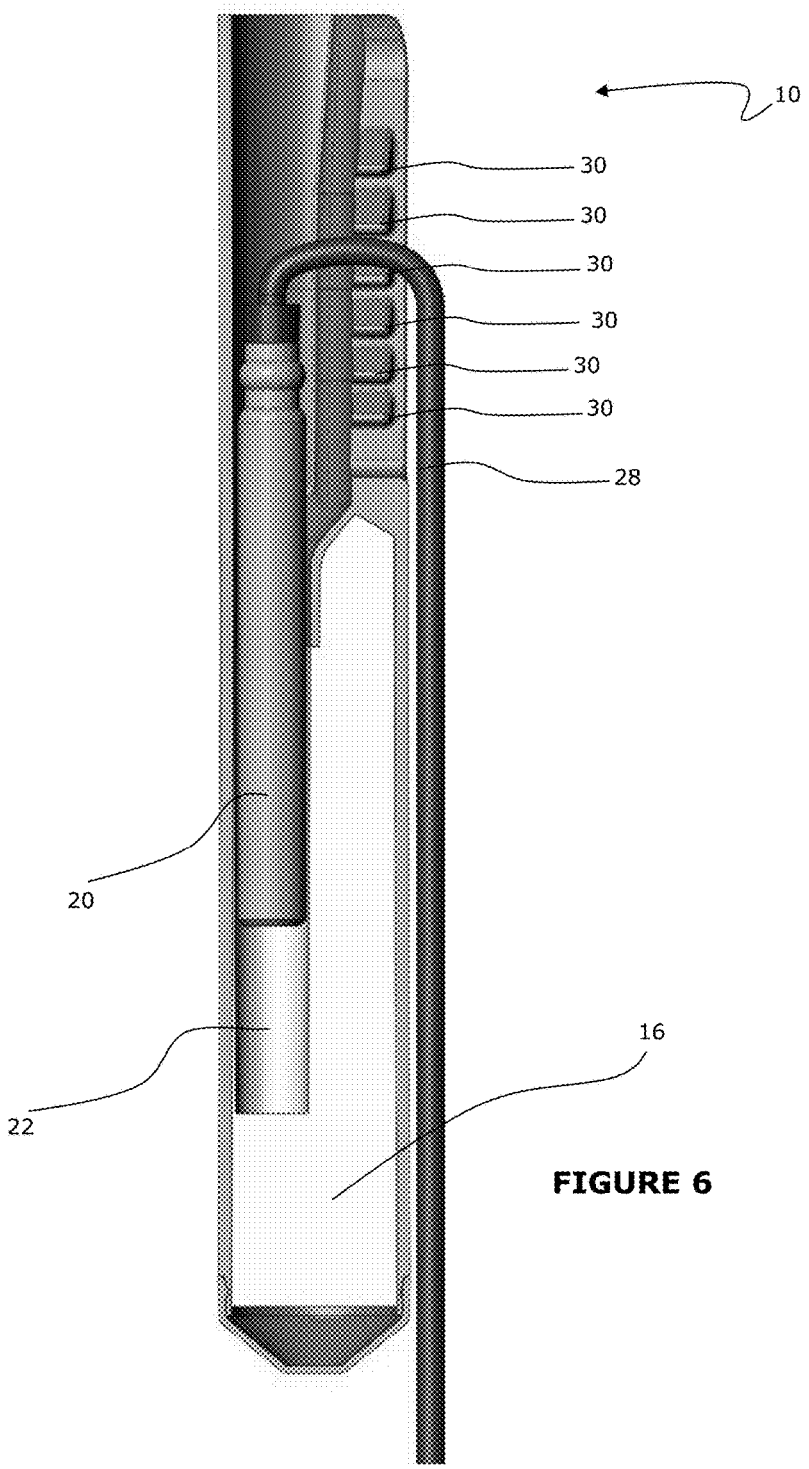
FIG. 6 is a sectional view of the shell, shown at an intermediate step during insertion of the shortest detonator.
Figure 7:
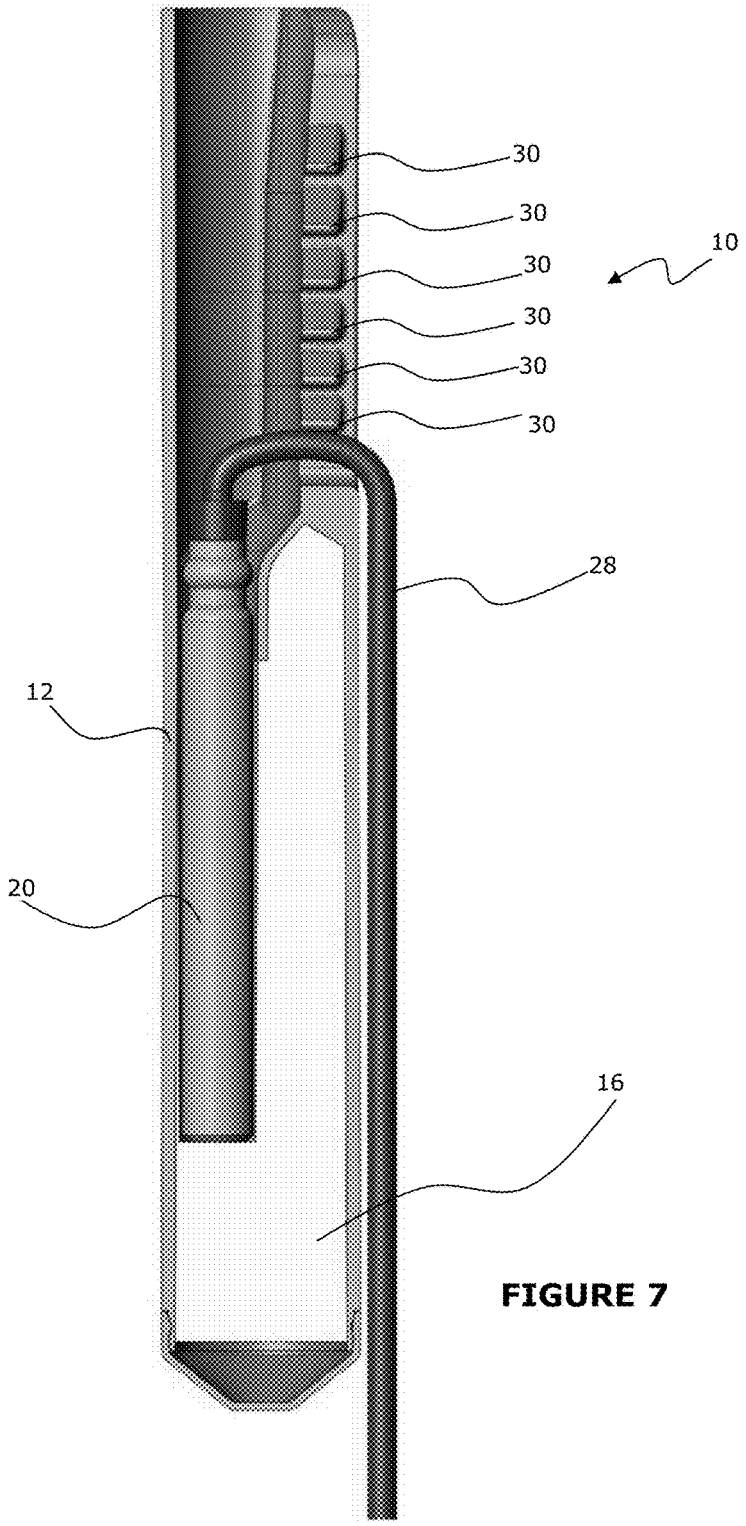
FIG. 7 is a sectional view of the shell shown with the shortest detonator inserted in place at an end of a cavity of the shell.
Figure 8:
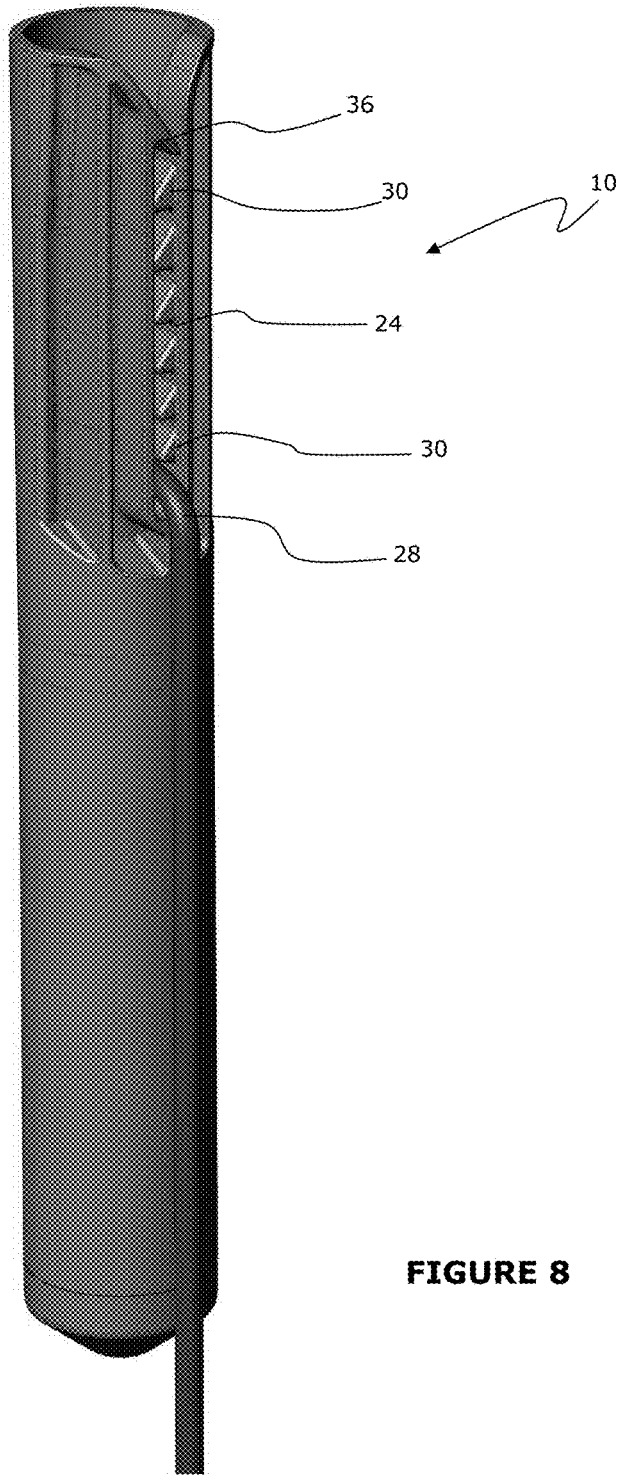
FIG. 8 is a front perspective view of the shell, shown with the shortest detonator positioned in place at the end of the cavity.

FIGS. 5 to 7 show progressive movement of the shortest detonator 20 along the cavity 22 such that in FIG. 7 the detonator 20 resides up against an end of the cavity 22, with the activation lead 28 retained by the inner-most one of the retaining protrusions 30. In this way, the innermost retaining protrusion 30 prevents unwanted withdrawal of the detonator 20 and ensures that the detonator 20 is maintained in the optimum position for reliability of operation of the shell 10. FIG. 8 shows an external front perspective view of the shell arrangement in FIG. 7 wherein the activation lead 28 is retained by the inner-most one of the retaining protrusions 30 when the shortest detonator 20 is held in place against the end of the cavity 22.

Figure 9:
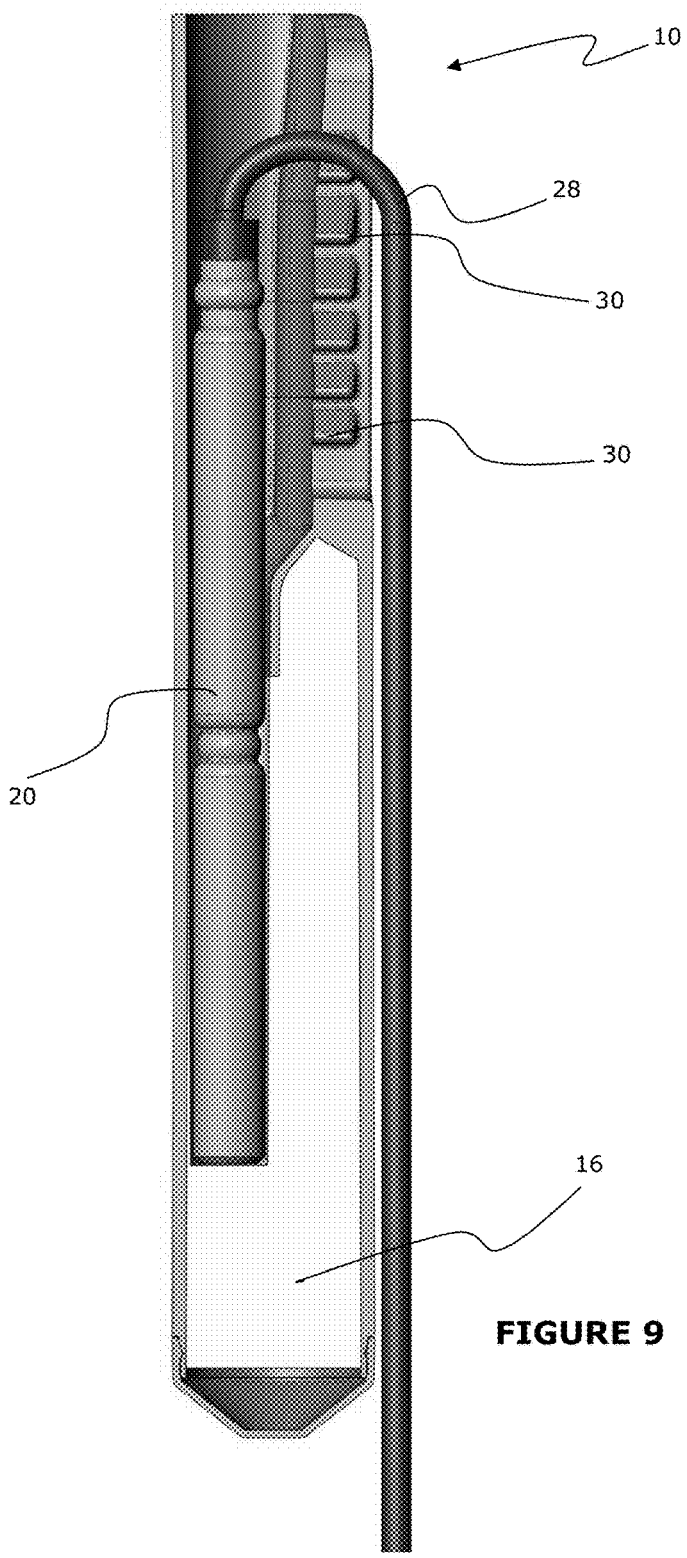
FIG. 9 is a sectional view of the shell, shown with the longest detonator located in place at the end of the cavity.
Figure 10:
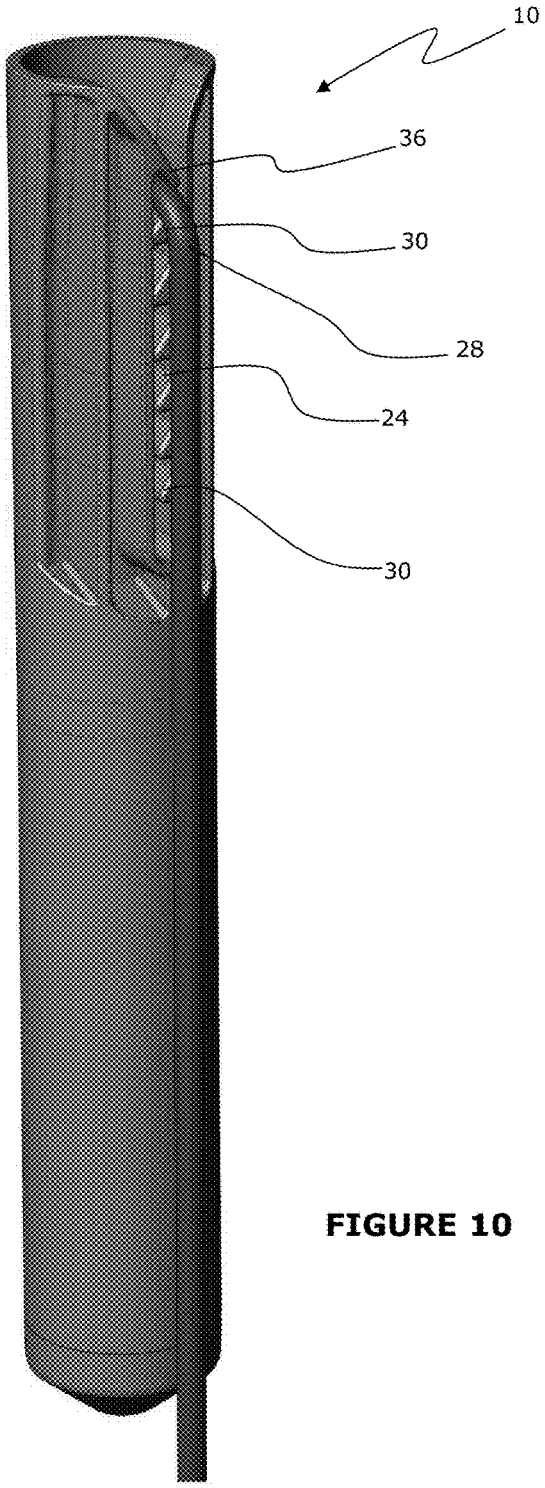
FIG. 10 is a front perspective view of the shell, shown with the longest detonator in place against the end of the cavity of the shell.
Figure 11:
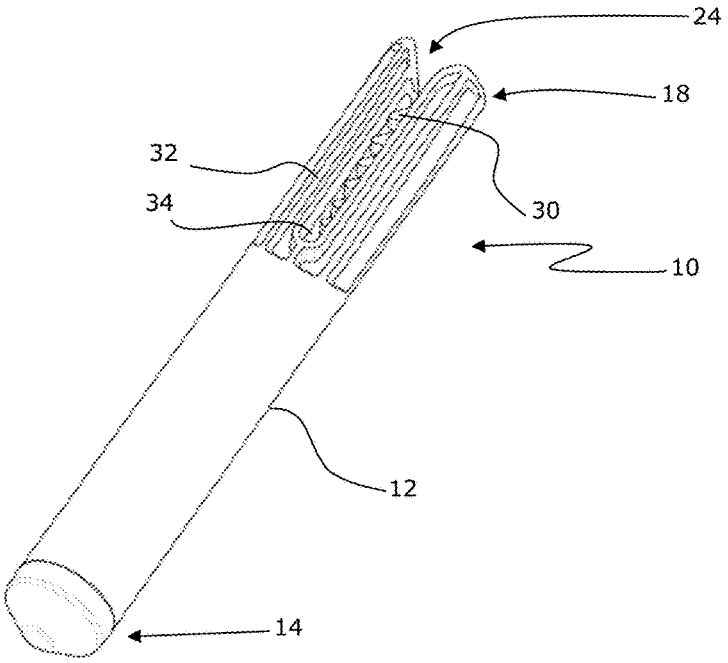
FIG. 11 is a perspective view from one end of a shell for use in blasting.
Figure 12:
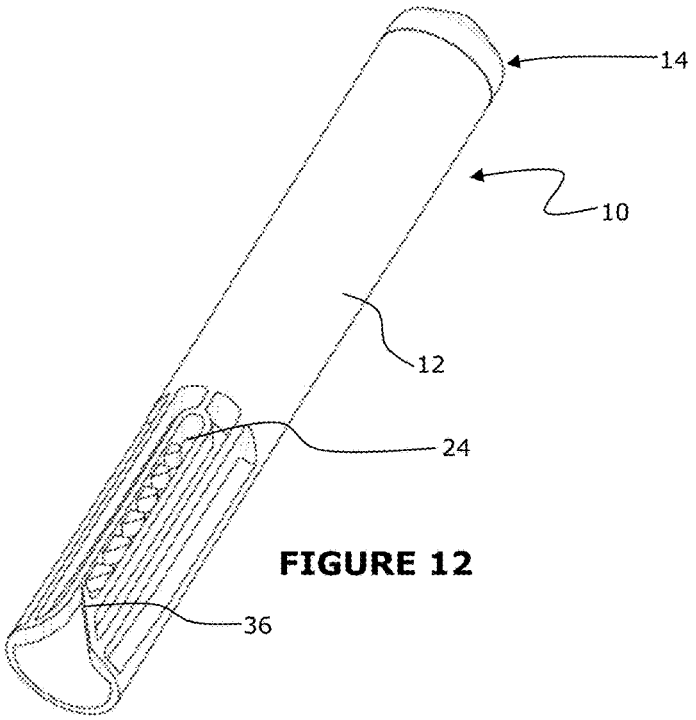
FIG. 12 is a perspective view from an opposite end of the shell shown in FIG. 11.
Figure 13:
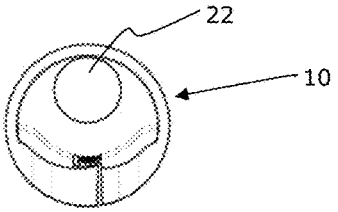
FIG. 13 is a top view of the shell.
Figure 14:
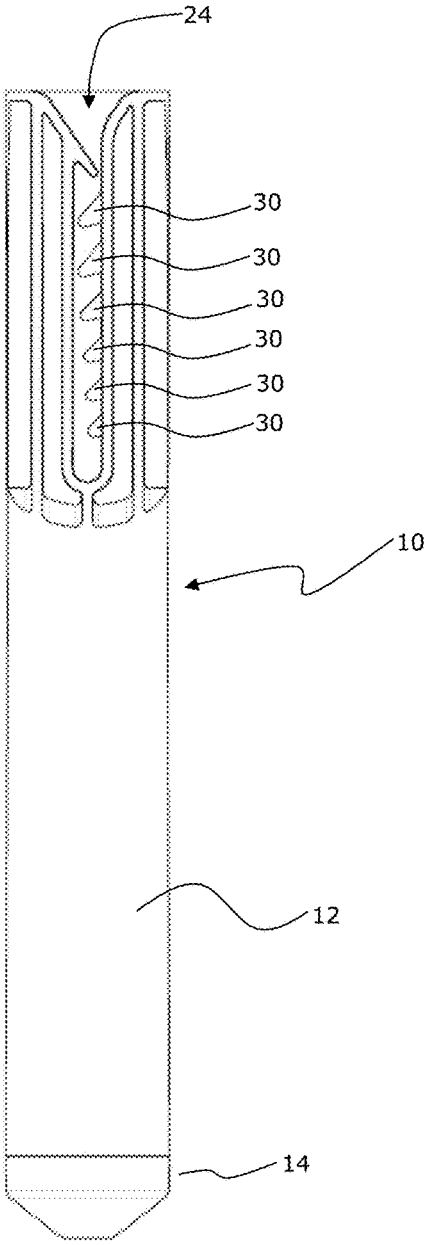
FIG. 14 is a front view of the shell.
Figure 15:
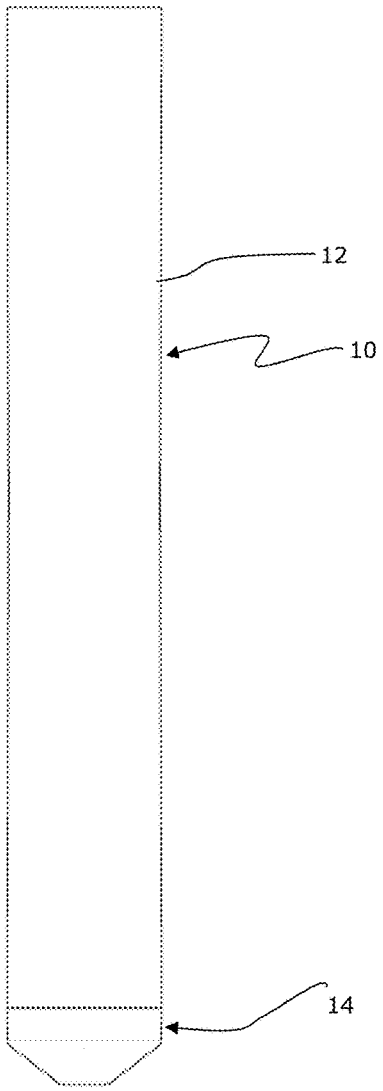
FIG. 15 is a rear view of the shell.
Figure 16:
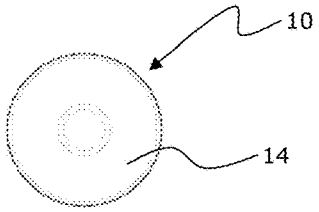
FIG. 16 is a bottom view of the shell.
Figure 17:
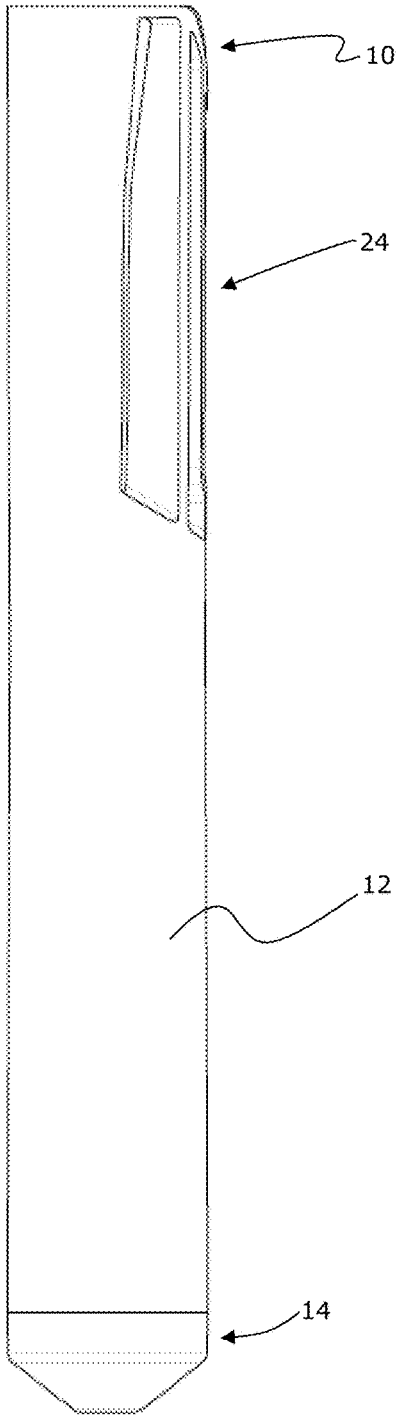
FIG. 17 is a left side view of the shell.
Figure 18:
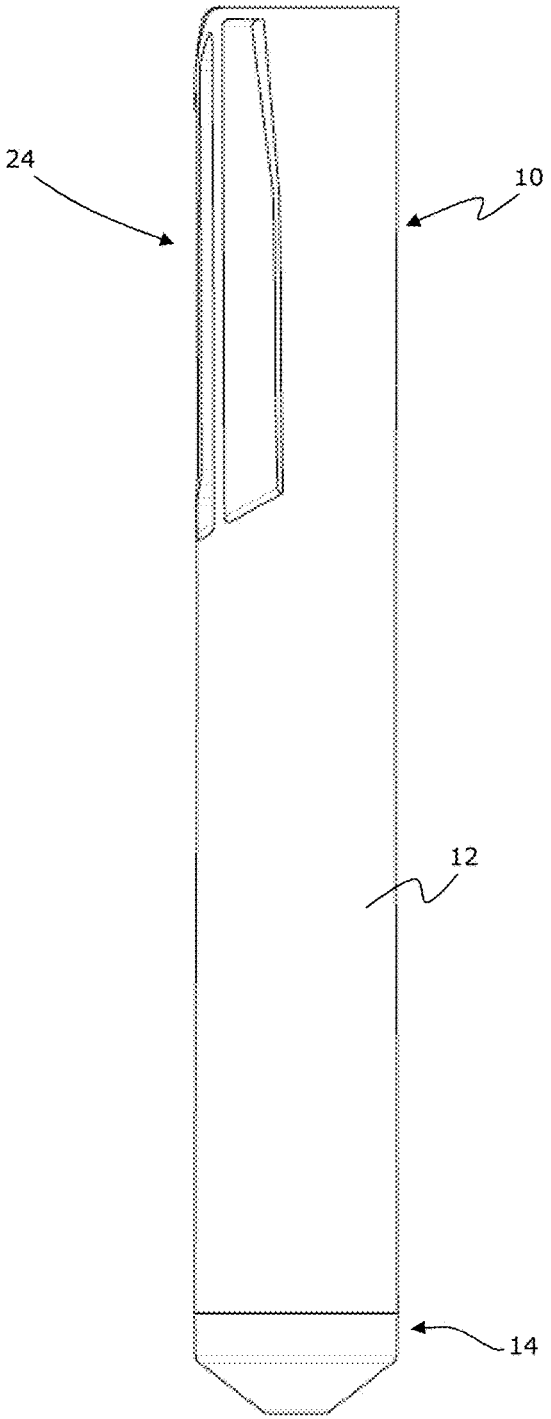
FIG. 18 is a right side view of the shell.

FIGS. 9 and 10 show the shell 10 when used with a longest detonator 20. Specifically, FIG. 9 shows a sectional view of the shell 10 with the longest detonator 20 in position up against the distal end of the cavity 22, and FIG. 10 shows an external front perspective view of the shell 10 with the activation lead 28 retained by the proximal barb 36.

As will be appreciated, the first tooth, or proximal barb 36, is reversed to act as a safety stop to help prevent a lead from completely exiting the slot 24 if it is pulled hard enough in the wrong direction. The slot 24 still allows for simple intentional removal of detonators, if required.

In addition to the smooth finish on the opposite side of the teeth, the intentional removal is also facilitated by the round teeth shape instead of sharp teeth which are purposely designed in such way to allow detonators be removed without damage to the lead. This feature may be required in mining applications, in particular in situations where charge crews will be in a hurry to charge a last development face with very limited time left before the end of a working shift or the end of a working day. Typically, primers are assembled while waiting for drilling to be finished. More often than not, this results in more assembled primers than is necessary or an inappropriate delay number assembled. At the end of their shift, the workers need to disassemble the primers which are to be returned to the magazine. This disassembly may be done more efficiently by using the present invention.

The slot 24 ensures detonators can be fully inserted to the end of the cavity (or det-well), and the teeth retain the detonator position against the end of the cavity 22. As will be appreciated from FIGS. 5 to 7, after the detonator 20 is inserted initially, the activation lead 28 may be pulled downwardly, clicking down through the teeth in the slot 24 until the detonator 20 is in position. Detonators of intermediate lengths may be held in place by the intermediate teeth. The teeth prevent the detonator 20 from sliding backwards which would create a space between the detonator 20 and the end of the cavity 22, or a "stand-off". When the detonator 20 sits against the distal end of the cavity 22 the detonator 20 is said to have a zero stand-off.

Advantageously, the new detonator locking design of an explosives booster and primer described herein provides an integral fastening means for positive retention of different types of tubes including shock tubes for non-electric detonators, leg wires for electric detonators and lead wires for electronic detonators. The design allows the detonator caps made from different shell lengths to be securely enclosed and positioned inside the booster. The design ensures that the bottom of the detonator base charge is in direct contact with the booster composition (no offset of detonator bottom to end of det-well (or "cavity"), which ensures the effective and reliable detonation of boosters.

In any booster, the effect of detonator stand-off can have a detrimental impact on booster reliability, increasing the chance of a misfire and reducing booster output. A detonator stand-off occurs when the base charge of a detonator is positioned with a gap between the end of the detonator, and the end of the det-well in the booster. Using a single booster design with many different available detonator lengths means the shorter detonators have an almost certain chance of detonator stand-off as they cannot be held and retained against the end of the det-well which is made long enough to suit the longest detonators. When a short detonator is inserted in to the det-well, the tension applied to the shock tube or wire during the priming procedure immediately pulls the short detonators to the top of the det-well resulting in a det stand-off of up to 35 mm. Solving this problem for the shell illustrated has highlighted that the resulting solution could also be applied to other booster designs to prevent stand-off.

The example of the invention shown in the drawings features a slot down one side of the det-well. The slot has angled teeth down one side of it. When a short detonator is inserted into det-well, the user clicks the shock tube or wire (lead) down through the teeth in the slot. The shorter the detonator, the more teeth the lead will click through and the further down the slot the lead will go. Once the detonator bottoms out at the end of the det-well, the lead cannot click down through any further teeth and it is retained in this position by the last tooth it clicked through. With the lead being retained by the teeth means the detonator cannot slide backwards in the det-well and therefore no detonator stand-off is likely to exist.

The profile of the teeth has been the focus of development to achieve a solution that allows for simple insertion of the lead, yet still retains the lead adequately to prevent it coming loose during deployment of the booster. For the occasional time when a user must remove the detonator from the booster, this can be done by flexing the slot open (the plastic material allows for enough flexibility) and sliding the lead backwards out of the slot which then drags the detonator out of the det-well. The slot only has teeth on one side to facilitate simple intentional removal of the lead as it allows the lead to slide backwards against a smooth surface. As mentioned above, this simple intentional removal is also facilitated by the round teeth shape instead of sharp teeth which are purposely designed in such way to allow detonators be removed without damage to the lead.

The tooth closest to the open end of the slot is on the opposite side of the slot to the other teeth and has more reverse angle to it. The purpose of this tooth is to retain the lead for the longest detonator, but it also acts as a safety stop in the event that an already inserted lead is pulled with excessive force towards the open end of the slot, even if the lead slips back through the teeth, it will be caught by this last tooth to prevent the detonator completely separating from the booster. In this event a detonator stand-off will have been created however the booster should still fire, just with reduced reliability compared to a zero stand-off detonator position.

Insertion of the detonator may be faster than with existing booster designs. More specifically, insertion may be faster with this new design than the traditional booster design with two det-wells, commonly one "blind" or "stepped" det-well and another "through" det-well. When a detonator is inserted into a traditional booster, it is pushed through the "through" det-well then pushed into the second det-well, "blind" or "stepped". With the new tooth design feature, the detonator is simply pushed down and then locked into place. Examples of the present invention may also prevent the detonators from rattling in the det-well which is an issue in current booster designs. A safety advantage is the increased booster reliability, meaning less chance of a misfire event. As will be appreciated, misfires are a significant safety and financial risk.

FIGS. 11 to 18 show black and white line drawings of a shell similar to the shell depicted in FIGS. 1 to 10, and like features are indicated with like reference numerals.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention as follows:

1. A shell for use in blasting, the shell comprising an elongated body, the elongated body having a distal end arranged for housing an explosive material, a proximal end arranged to permit introduction of at least one detonator into an interior of the shell, and a cavity for holding the at least one detonator in a location in which operation of the detonator results in explosion of the explosive material, wherein a slot is provided in a sidewall of the shell to allow an activation lead connected to the detonator to pass through the slot to an exterior of the shell, wherein the slot extends longitudinally along the sidewall and wherein the slot includes a plurality of retaining protrusions along the slot to retain the activation lead against withdrawal of the activation lead from the slot, the retaining protrusions being spaced along the length of the slot to provide a plurality of spaced positions along the length of the slot at which the activation lead can be retained to allow positioning of detonators of different lengths.

2. A shell as claimed in claim 1, wherein the retaining protrusions are at regular spaced intervals along the slot.

3. A shell as claimed in claim 1, wherein the retaining protrusions are along only one side of the slot and an opposite side of the slot includes a smooth wall adapted to bear against the activation lead while the activation lead is drawn inwardly along the slot past one or more of the retaining protrusions.

4. A shell as claimed in claim 1, wherein the retaining protrusions are barbed to facilitate movement of the activation lead into the slot and to restrain the activation lead against movement out of the slot.

5. A shell as claimed in claim 1, wherein the slot includes a proximal barb on an opposite side of the slot to the retaining protrusions and wherein the proximal barb laterally overlaps the retaining protrusion across the width of the slot.

6. A shell as claimed in claim 1, wherein the elongated body is arranged for insertion and explosion in a hole.

7. A shell as claimed in claim 1, wherein the retaining protrusions are adapted to hold the detonator in a location in which operation of the detonator results in explosion of the explosive material.

8. A shell as claimed in claim 1, wherein the retaining protrusions are adapted to hold a range of detonators of different lengths in a location in which a distal end of the detonator is positioned against an end of the cavity such that operation of the detonator results in explosion of the explosive material.

9. A shell as claimed in claim 8, wherein the retaining protrusions are adapted to accommodate detonators ranging from a length of 64 mm to 99 mm.

10. A shell as claimed in claim 1, wherein the slot extends longitudinally along the sidewall from an opening of the slot at the proximal end of the sidewall.

11. A shell as claimed in claim 1, wherein the activation lead is in the form of an activation wire.

* * * * *